US008784056B2

(12) United States Patent
Willett, Jr.

(10) Patent No.: US 8,784,056 B2
(45) Date of Patent: Jul. 22, 2014

(54) SYSTEM AND TURBINE INCLUDING CREEP INDICATING MEMBER

(75) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 585 days.

(21) Appl. No.: 13/110,090

(22) Filed: May 18, 2011

(65) Prior Publication Data

US 2012/0294704 A1 Nov. 22, 2012

(51) Int. Cl.

| | |
|---|---|
| ***F01D 25/04*** | (2006.01) |
| ***F01D 21/00*** | (2006.01) |
| ***F01D 11/08*** | (2006.01) |

(52) U.S. Cl.

CPC ..... *F01D 21/003* (2013.01); *F05D 2260/80* (2013.01); *F01D 11/08* (2013.01)

USPC ..... 416/61; 415/118

(58) Field of Classification Search

CPC ..... F01D 25/00; F04D 29/66; F04D 29/661; F04D 29/00

USPC ..... 415/118; 416/61

See application file for complete search history.

(56) References Cited

U.S. PATENT DOCUMENTS

| | | | | |
|---|---|---|---|---|
| 5,140,528 | A | 8/1992 | Swaminathan et al. | |
| 6,594,619 | B1 | 7/2003 | von Flotow | |
| 6,785,635 | B2 | 8/2004 | von Flotow | |
| 2002/0019708 | A1 * | 2/2002 | Pross | 702/36 |
| 2006/0201257 | A1 | 9/2006 | Soechting et al. | |
| 2007/0285110 | A1 | 12/2007 | Nigmatulin et al. | |
| 2009/0178417 | A1 * | 7/2009 | Draper et al. | 60/783 |

OTHER PUBLICATIONS

Search Report and Written Opinion from FR Application No. 1254530 dated Jan. 21, 2012.

* cited by examiner

*Primary Examiner* — Ned Landrum
*Assistant Examiner* — Aaron Jagoda
(74) *Attorney, Agent, or Firm* — Ernest G. Cusick; Hoffman Warnick LLC

(57) ABSTRACT

A system includes a creep indicating member on a rotating component, and a measurement device configured to measure a change in radial position of the creep indicating member. The system allows determination of, for example, rotating component life expectancy in a turbine, without exposing the rotating component.

17 Claims, 6 Drawing Sheets

SYSTEM AND TURBINE INCLUDING CREEP INDICATING MEMBER

BACKGROUND OF THE INVENTION

The disclosure relates generally to mechanical failure monitoring, and more particularly, to a system and turbine including a creep indicating member.

Mechanical part life, such as a rotor in a turbine, is dictated by one or more of several failure mechanisms. In turbine rotors subjected to high temperatures, creep and low cycle fatigue (LCF) are the prevalent failure mechanisms. Rotor failures can be catastrophic. A rotor burst can result in millions of dollars in damages and possibly loss of life. Consequently, rotors are designed for a useful life that is less than the predicted burst life, and is sufficiently less to greatly reduce the possibility of an in-service failure.

Many rotors have a limited creep life. Creep life prediction depends on many variables including temperature, stress, and material properties. Temperature and, through rotor speed, stress can be monitored during turbine operation. Material properties, however, vary from rotor to rotor. Unfortunately, the range of material properties can only be determined through destructive testing. Because of the variability in material properties, rotor lives, both predicted and actual, vary widely.

The extent of rotor creep can, for large rotors, be determined by measuring the rotor after a period of service. Typically, rotor diameter is measured, compared to the initial rotor diameter measurement, and correlated to a creep model to estimate the amount of creep, and hence the amount of life expended. Unfortunately, this approach requires good measurements of the new rotor, good data storage and retrieval, and disassembly of the turbine at the time of measurement. The disassembly requires expenditure of an extensive amount of time and costs.

BRIEF DESCRIPTION OF THE INVENTION

A first aspect of the disclosure provides a system comprising: a creep indicating member on a rotating component; and a measurement device configured to measure a change in radial position of the creep indicating member.

A second aspect of the disclosure provides a turbine comprising: a rotating component; a creep indicating member on the rotating component; a measurement device configured to measure a change in radial position of the creep indicating member during operation of the rotating component; and a creep correlation system configured to correlate a creep amount of the creep indicating member to a creep amount of the rotating component.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
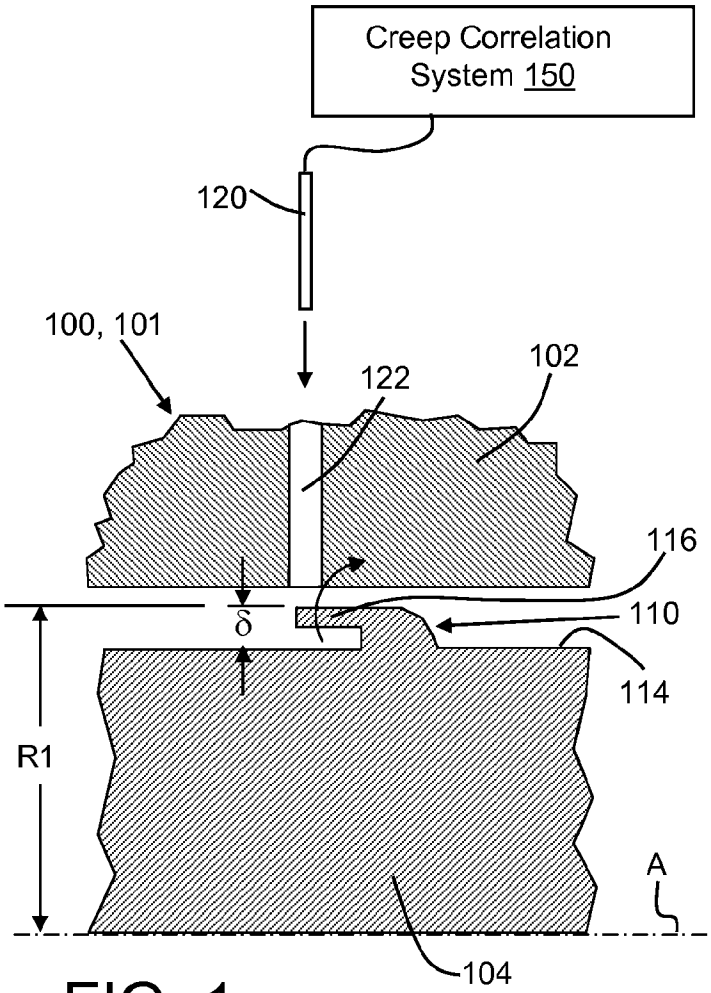
FIG. 1 shows a cross-sectional view of a system including a creep indicating member according to embodiments of the invention.
Figure 2:
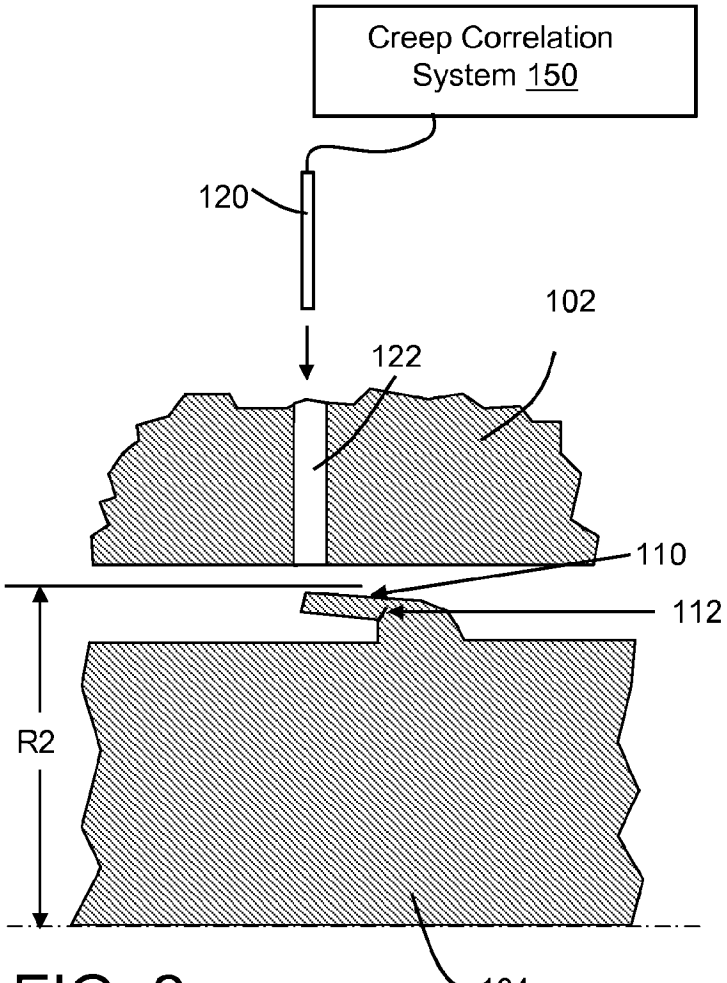
FIG. 2 shows a cross-sectional view of the system of FIG. 1 after a period of use.

As indicated above, the disclosure provides a system for mechanical failure monitoring including a creep indicating member. Referring to FIGS. 1 and 2, one embodiment of a system 100 including a creep indicating member according to embodiment of the invention is illustrated. System 100 is illustrated in the setting of a turbine 101 including a stator 102 and a rotating component 104 in the form of, for example, a rotating shaft or rotor. Only a portion of each structure is shown for clarity. Other applications may also be possible and are considered within the scope of the invention. Stator 102 may be part of a protective shroud about rotating component 104. Rotating component 104 rotates into and out of the page of FIG. 1 about an axis A.

System 100 includes a creep indicating member 110 on rotating component 104. As will be described herein, creep indicating member 110 may be "on" rotating component 104 by being formed on a surface or in a surface of the rotating component, or by being coupled to rotating component. Creep indicating member 110 may be any structure configured to experience higher stress than rotating component 104, resulting in a greater creep rate than rotating component 104. That is, creep indicating member 110 is designed such that it will creep faster than the rest of rotating component 104, so its deflection is more pronounced and easier to measure. Creep indicating member 110 may be configured in this fashion through the use of specific materials, shape, size, or other features. "Creep" as used herein indicates tendency of a solid material to slowly move or plastically deform under the influence of stresses and temperature. Various embodiments of creep indicating member 110 will be described herein.

FIG. 2 shows creep indicating member 110 after a period of time. In FIG. 2, creep indicating member 110 has been deformed radially outward. A measurement device 120 is configured to measure a change in radial position (R2−R1) of creep indicating member 110, so as to provide an indication of life expectancy of rotating component 104. As will be described herein, measurement device 120 may extend through a port 122 in stator 102, e.g., a protective shroud, about rotating component 104. Numerous embodiments of measurement device 120 will also be described herein.

Figure 3:
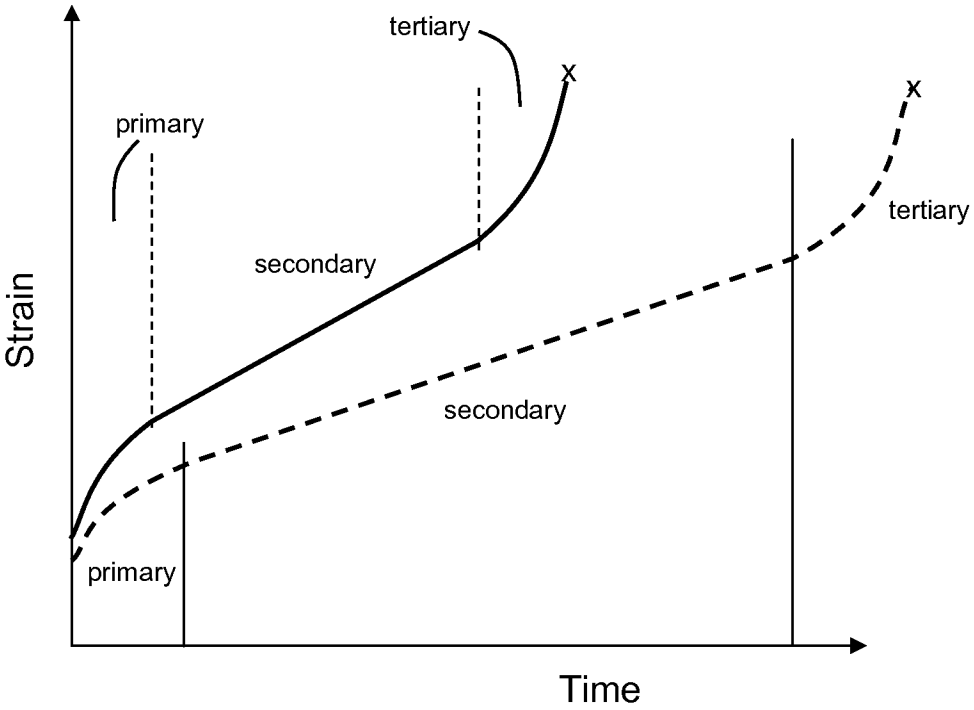
FIG. 3 shows a graph indicating creep of a rotating component versus a creep indicating member for use with a creep correlation system according to embodiments of the invention.

To illustrate how system 100 indicates life expenditure, deformation and/or impending mechanical failure of rotating component 104, FIG. 3 shows a graph of strain versus time. In FIG. 3, the dashed line indicates strain over time in a portion of rotating component 104, while the solid line shows strain over time of creep indicating member 110. Since creep indicating member 110 is more highly stressed, e.g., due to its shape, it creeps faster. Deformation of creep indicating member 110 radially outward as rotating component 104 rotates can be correlated to deformation in rotating component 104, e.g., using conventional modeling. In this fashion, creep indicating member 110 provides an indication of deformation in, and hence life expectancy of, rotating component 104 without having to actually measure rotating component 104.

Creep indicating member 110 may take a variety of forms. In FIGS. 1 and 2, creep indicating member 110 is integrally formed on rotating component 104. That is, creep indicating member 110 includes an additional amount of material on a surface 114 (FIG. 1) of rotating component 104 such that it extends radially beyond surface 114 of rotating component 104. In FIGS. 1 and 2, creep indicating member 110 includes a cantilevered element 116 (FIG. 1) that initially extends substantially parallel to a longitudinal axis A of rotating component 104. In this embodiment, cantilevered element 116 extends radially beyond surface 114 of rotating component 104. As rotating component 104 rotates over time, as shown by the curved arrow in FIG. 1, cantilever element 116 bends or deflects radially outwardly from a radial position R1 to a new radial position R2, as shown in FIG. 2. The cantilever design of creep indicating member 110 exaggerates the deflection for a given amount of creep strain, making measurement easier. Creep indicating member 110 may be formed in any manner now known or later developed. For example, it may be incorporated into the forging for rotating component 104, machined from a forging along with surface 114, or welded to rotating component 104 either in finished form or with machining to shape being provided thereafter.

Figure 5:
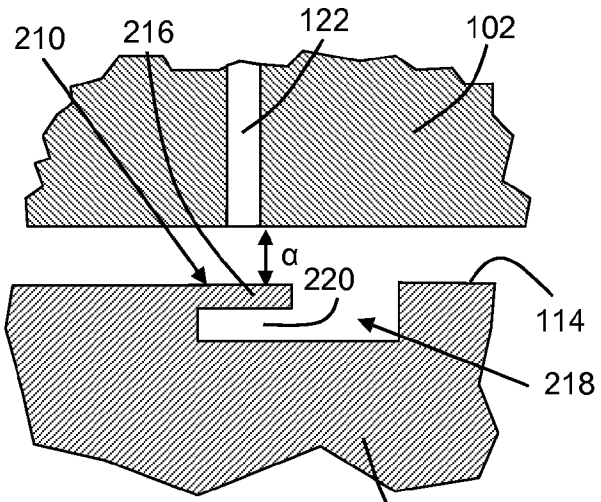
FIGS. 4 and 5 show a plan view and a cross-sectional view, respectively, of an alternative embodiment of a creep indicating member according to embodiments of the invention.
Figure 4:
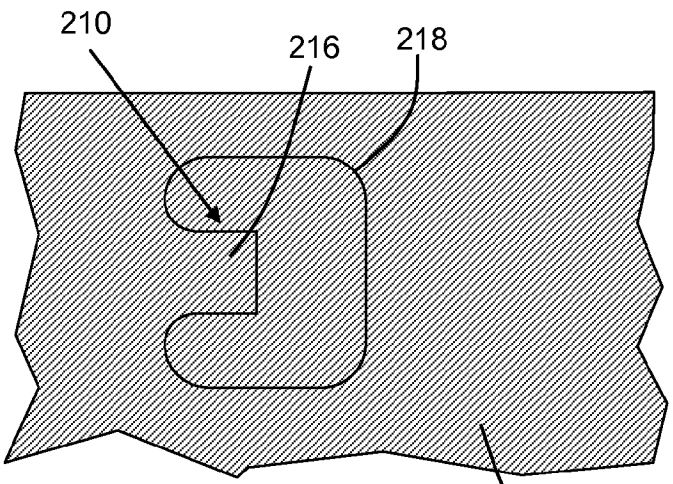
Figure 6:
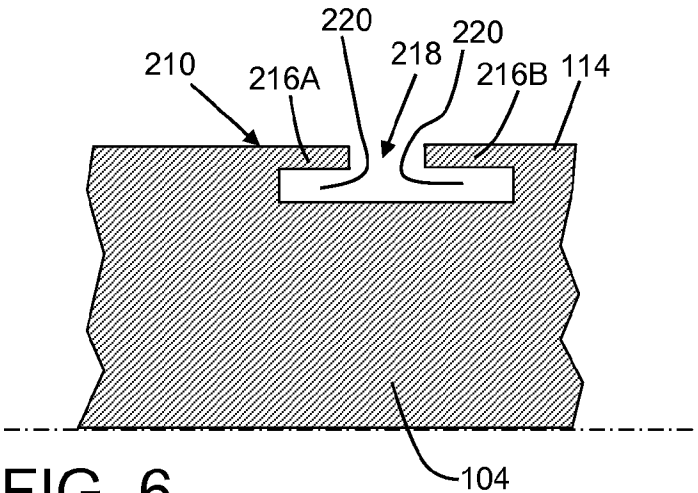
FIG. 6 shows a cross-sectional view of another embodiment of a creep indicating member according to the invention.

In contrast, as shown in FIGS. 4-6, in an alternative embodiment, a creep indicating member 210 may be formed in rotating component 104. In this embodiment, creep indicating member 210 includes a cantilevered element 216 that is initially substantially flush with surface 114 (FIGS. 5 and 6) of rotating component 104. Cantilevered element 216 may be formed by machining an opening 218 in rotating component 104 in any now known or later developed manner. Opening 218 includes an undercut 220 to form cantilevered element 216. As shown in FIG. 6, in an alternative embodiment, cantilevered element 216 may include a pair of longitudinally opposed cantilevered elements 216A, 216B, e.g., by having opening 218 include a pair of undercuts 220. The FIGS. 4-6 embodiments are more difficult to produce, but have an advantage, among others, that they can be applied to existing, or fielded, rotors. That is, rotors that were designed and produced before conception of embodiments of this invention.

Figure 8:
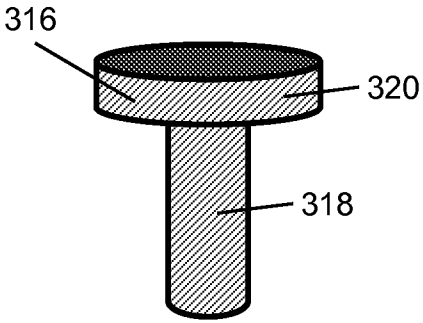
FIGS. 7 and 8 show a cross-sectional view and a perspective view, respectively, of another embodiment of a creep indicating member according to the invention.
Figure 7:
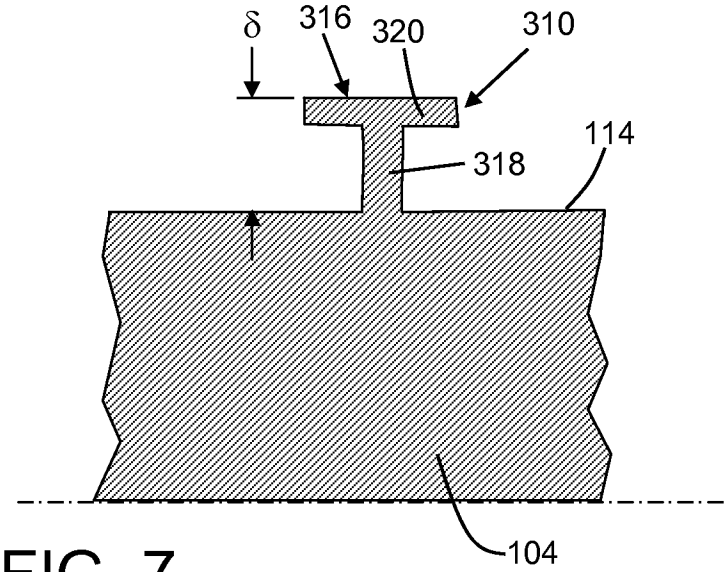

FIGS. 7 and 8 show another alternative embodiment in which a creep indicating member 310 includes a pinhead-shaped element 316 extending from surface 114 of rotating component 104. Pinhead-shaped element 316 may include, for example, a stem 318 and a flattened head 320. Creep indicating member 310 may be provided on rotating component 104 in any fashion as described relative to the FIGS. 1 and 2 embodiments. Stem 318 is under pure tensile load (rather than bending as in other embodiments) and creeps over time. Flattened head 320 provides added weight to increase the centrifugal pull on stem 318.

In each of the above-described creep indicating member embodiments, the drawings indicate that the respective creep indicating member is present at only a portion of the circumference of rotating component 104, e.g., a rotating shaft. In these cases, multiple local creep indicating members 110 may be arranged circumferentially spaced about rotating component 104 to provide proper balance of rotating component 104. In alternative versions, however, such as those of FIGS. 1, 2 and 9, creep indicating member 110 may extend about an entire circumference of rotating component 104, e.g., a rotating shaft. In this latter case, no rotating component 104 imbalance is presented.

Figure 10:
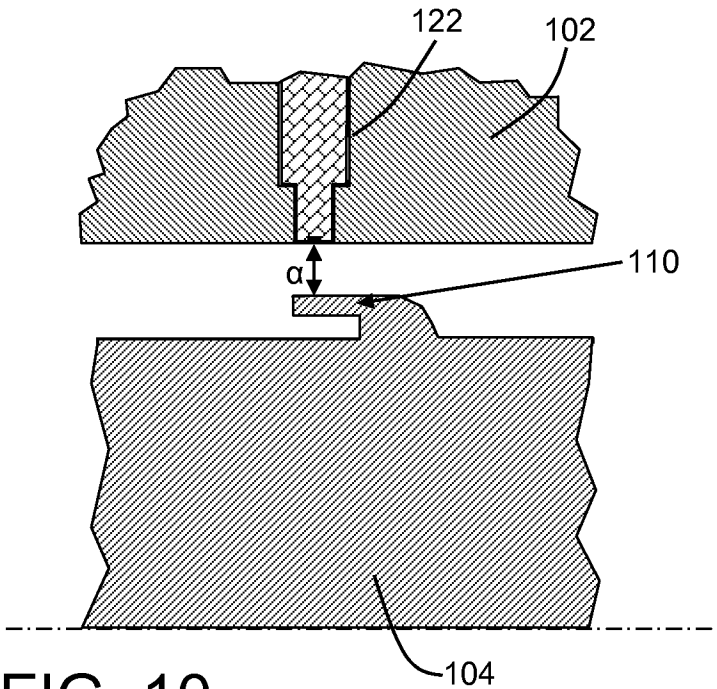
FIGS. 9 and 10 show cross-sectional views of other embodiments of a system including a creep indicating member according to the invention.
Figure 9:
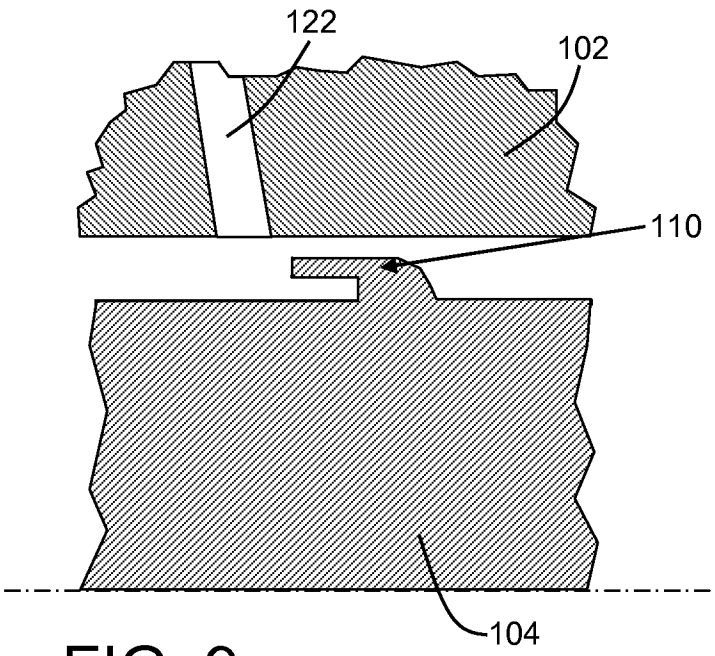

Referring to FIGS. 1 and 2, along with FIGS. 9 and 10, measurement device 120 (FIGS. 1 and 2) may include a variety of devices capable of measuring or detecting the change in radial position of creep indicating member 110, 210, 310 (hereinafter referred to collectively as "creep indicating member 110"). Rotating component 104 does not need to be removed from its location, e.g., within stator 102 of a turbine, in order to determine life expenditure, deformation, etc., of rotating component 104. As noted herein, measurement device 120 is provided through port 122 in stator 102. Port 122 may open radially outward of creep indicating member 110, as shown in FIGS. 1, 2, 5 and 10. In this case, measurement device 120 may include, for example, a dial indicator or laser measurement device. Alternatively, port 122 may open to creep indicating member 110 at an angle, as shown in FIG. 9. In this case, measurement device 120 may include a borescope, which may also be employed for visual inspection. Where measurement device 120 (FIG. 1) includes a clearance sensor, it may be possible to make the measurement during operative rotation of rotating component 104. Decreasing clearance between creep indicating member 110 and stator 102 would indicate creep. In this case, turbine 101 would not need to be stopped.

Measurement of the change in radial position (R2–R1) can be accomplished in a number of ways. Measuring a creep distance $\delta$, as shown in, for example, FIGS. 1 and 7, is one approach. Another approach is to measure the change in clearance $\alpha$, as shown in FIG. 5, between creep indicating member 210 on rotating component 104 and stator 102. While this latter approach is probably an easier measurement than that proposed in FIGS. 1 and 7, it may require that turbine 101 (or other machine in which system 100 is applied) be allowed to cool to ambient temperature. However, clearance can be measured continuously whenever turbine 101 is operating. In this fashion, a decrease in steady state clearance a over time can be correlated to creep strain, and hence rotor life expenditure. Again, an advantage of clearance sensor type of measurement device 120 (FIG. 1) is that interruption of turbine operation is not required for data collection.

Referring to FIG. 1, system 100 may also include a creep correlation system 150 configured to correlate a creep amount of creep indicating member 110 to a creep amount of rotating component 104. Creep correlation system 150 may employ any now known or later developed predictive, computerized models. In one embodiment, creep correlation system 150 may correlate an expected creep amount for a new rotating component 104 with a creep indicating member 110 based on, for example, expected materials, known size, known operating environment, etc.

Figure 11:
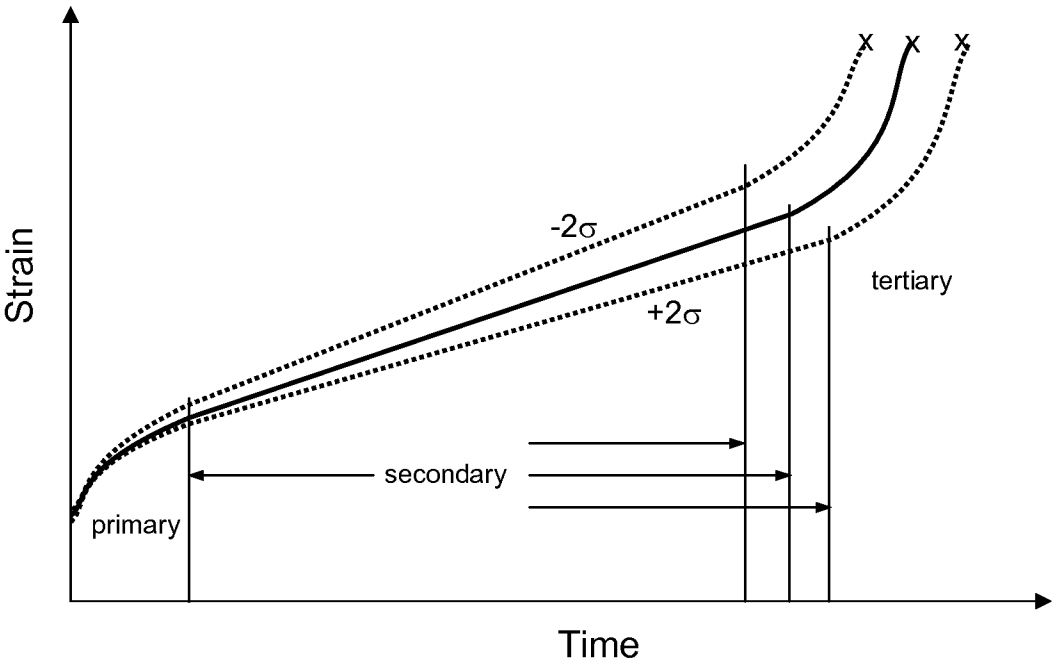
FIG. 11 shows a graph indicating modeling of creep for an existing rotating component for use with a creep correlation system according to embodiments of the invention.

Alternatively, as explained with reference to FIG. 11, a creep indicating member 110 may be useful to monitor a rotating component 104 part way through its life. In FIG. 11, the solid curve represents rotating component 104 material average creep properties. The dashed curves represent the range of creep property uncertainty, defined in this example as +/– two standard deviations ($\pm 2\sigma$). The properties of any rotating component 104 of the given material lies somewhere in the continuum bounded by the range of uncertainty. By measuring the creep deformation in a creep indicating member 110 that has been added to the rotating component 104 at points in time, the rate of deformation thereof can be determined. With this measured rate of deformation of the added creep indicating member 110, creep correlation system 150 can establish creep properties for the particular rotating component 104 and estimate an expended life using any now known or later developed modeling technique. Another, simpler approach is to actually measure rotating component 104 diameter in several locations during major inspections for comparison to the as-built dimensions to determine the rate of creep deformation thereof. With these measurements taken at a major inspection, creep correlation system 150 can predict the expended life based on creep indicating member 110 and on the operational data.

Returning to FIG. 2, at some point in the life of turbine 101, after creep indicating member 110 has deflected substantially, the member itself may enter the tertiary creep regime and a crack(s) 112 may form. To prevent damage from liberated material, some precautions may be necessary. One solution is to design creep indicating member 110 such that any liberated material is sufficiently small so as to cause minimal damage. Another solution is to remove creep indicating member 110, e.g., by machining rotating component 104, after a pre-determined amount of creep strain has been recorded. The timing of this latter approach could be matched to coincide with a major inspection of rotating component 104 and/or represent some lifespan milestone (e.g., 75%) of rotor life expenditure.

It is emphasized that the creep indicating members described herein may also include a variety of other shapes not described herein capable of changing radial position over time.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A system comprising:

a creep indicating member disposed on a rotating component;

wherein the creep indicating member has a first end and a second end;

wherein the first end of the creep indicating member is directly affixed to a surface of the rotating component such that the creep indicating member extends radially outward from the rotating component;

wherein the second end of the creep indicating member includes a cantilevered element extending substantially parallel to a longitudinal axis of the rotating component prior to undergoing creepage;

wherein the creep indicating member including the cantilevered element extends about an entire circumference of the rotating component; and a measurement device configured to measure a change in radial position of the cantilevered element.

2. The system of claim 1, wherein the creep indicating member is integrally formed on the rotating component.

3. The system of claim 1, wherein the creep indicating member is fixedly coupled to the rotating component.

4. The system of claim 3, wherein the creep indicating member is fixedly coupled to the rotating component using a retainer.

5. The system of claim 1, wherein the cantilevered element includes a pair of longitudinally opposed cantilevered elements.

6. The system of claim 1, wherein the cantilevered element extends radially beyond a surface of the rotating component.

7. The system of claim 1, wherein the cantilevered element includes a seal material coupled to the rotating component using a retainer.

8. The system of claim 1, wherein the creep indicating member includes a pinhead-shaped element extending from a surface of the rotating component.

9. The system of claim 1, wherein the rotating component includes a rotating shaft.

10. The system of claim 1, further comprising a creep correlation system comprising a computer configured to correlate a creep amount of the creep indicating member with a creep amount of the rotating component.

11. The system of claim 1, wherein the measurement device is operative during operation of the rotating component.

12. The system of claim 1, wherein the measurement device extends through a protective shroud about the rotating component.

13. The system of claim 1, wherein the creep indicating member is configured to experience higher stress than the rotating component, resulting in a greater creep rate than the rotating component.

14. A turbine comprising:

a rotating component;

a creep indicating member disposed on the rotating component;

wherein the creep indicating member has a first end and a second end; the first end being directly affixed to a surface of the rotating component such that the creep indicating member extends radially outward from the rotating component; and wherein the second end of the creep indicating member includes a cantilevered element;

wherein, prior to undergoing creepage, the cantilevered element is in a first position, in which the cantilevered element extends in a direction substantially parallel to a longitudinal axis of the rotating component, and wherein, after undergoing creepage the cantilevered element is in a second position, in which the cantilevered element extends both axially and radially outwardly from the rotating component, the second position being disposed radially outwardly of the first position; and wherein the creep indicating member including the cantilevered element extends about an entire circumference of the rotating component;

a measurement device configured to measure a change in radial position of the cantilevered element during operation of the rotating component; and a creep correlation system comprising a computer configured to correlate a creep amount of the creep indicating member with a creep amount of the rotating component.

15. The turbine of claim 14, wherein the creep indicating member includes a cantilevered element initially extending substantially parallel to a longitudinal axis of the rotating component.

16. The turbine of claim 14, wherein the creep indicating member is configured to experience higher stress than the rotating component, resulting in a greater creep rate than the rotating component.

17. A system comprising:

a creep indicating member disposed on a rotating component, the creep indicating member having a first end and a second end, wherein the first end of the creep indicating member is directly affixed to a surface of the rotating component such that the creep indicating member extends radially outwardly from the rotating component; and the second end of the creep indicating member includes a cantilevered element;

a measurement device configured to measure a change in radial position of the cantilevered element;

wherein the cantilevered element extends substantially parallel to a longitudinal axis of the rotating component before undergoing creepage and the cantilevered element deforms radially outwardly after undergoing creepage; and wherein the creep indicating member including the cantilevered element extends about an entire circumference of the rotating component.

* * * * *